US007063248B2

(12) United States Patent
Noh et al.

(10) Patent No.: US 7,063,248 B2
(45) Date of Patent: Jun. 20, 2006

(54) STAPLER MOVING GUIDE DEVICE

(75) Inventors: Seung-Kyoon Noh, Seoul (KR); Seung-Gweon Lee, Gyeonggi-do (KR); Umehara Kenji, Tokyo (JP)

(73) Assignees: KRDC Co., Ltd., Seoul (KR); GRADCO Ltd., Tokyo (JP)

( * ) Notice: Subject to any disclaimer, the term of this patent is extended or adjusted under 35 U.S.C. 154(b) by 0 days.

(21) Appl. No.: 10/493,957

(22) PCT Filed: Aug. 5, 2002

(86) PCT No.: PCT/KR02/01478

§ 371 (c)(1),
(2), (4) Date: Nov. 2, 2004

(87) PCT Pub. No.: WO03/038530

PCT Pub. Date: May 8, 2003

(65) Prior Publication Data

US 2005/0051589 A1 Mar. 10, 2005

(30) Foreign Application Priority Data

Oct. 31, 2001 (KR) ..... 2001/67695
May 20, 2002 (KR) ..... 2002/27832

(51) Int. Cl.
*B25C 5/02* (2006.01)

(52) U.S. Cl. ..... 227/111; 227/110; 227/145; 227/148

(58) Field of Classification Search ..... 227/120, 227/110, 111, 145, 148, 143; 270/58.08, 270/37; 399/410
See application file for complete search history.

(56) References Cited

U.S. PATENT DOCUMENTS 4,382,592 A * 5/1983 Harding et al. ..... 270/58.01
4,509,732 A * 4/1985 Kanno et al. ..... 270/37
5,573,233 A * 11/1996 Hirai et al. ..... 270/58.08
5,772,197 A * 6/1998 Aoki et al. ..... 270/58.08
5,842,624 A * 12/1998 Ishida ..... 227/111
6,164,511 A * 12/2000 Chung et al. ..... 227/148

FOREIGN PATENT DOCUMENTS

GB 2345018 A * 6/2000
JP 4-329196 11/1992
JP 5-278365 10/1993

* cited by examiner

*Primary Examiner*—John Sipos
*Assistant Examiner*—Brian Nash
(74) *Attorney, Agent, or Firm*—Greenblum & Bernstein, P.L.C.

(57) ABSTRACT

A stapler moving guide device is disclosed, which can move regardless of a paper conveyer so as to enable multi-stapling at the end of papers and at the same time can move to a side portion at a tilt angle. The stapler moving guide device includes a stapler frame 131 provided with a stapler moving path 133 and a horizontal moving guide 52, a first moving plate 50 reciprocating along the horizontal moving guide, a second moving plate 51 reciprocating on the first moving plate in a direction perpendicular to the horizontal moving guide and moving in parallel with the first moving plate, and a stapler 124 fixed on the second moving plate.

6 Claims, 9 Drawing Sheets

Prior Art

Prior Art

STAPLER MOVING GUIDE DEVICE

TECHNICAL FIELD

The present invention relates to a stapler moving guide device that staples and finishes papers ejected from an image forming apparatus such as a printer, a copier, and a printer, and more particularly to a stapler moving guide device that can move regardless of a paper conveyer, which is provided to eject papers from a stapler before and after stapling and to move the papers to the stapler, so as to enable multi-stapling at the end of papers and at the same time can move to a side portion at a tilt angle.

BACKGROUND ART

A general image forming apparatus having a stapler will be described with reference to FIG. 1.

As shown in FIG. 1, the image forming apparatus such as a copier 1 includes a paper finishing apparatus 2 that finishes papers ejected from the image forming apparatus. The paper finishing apparatus 2 is located at a side of the image forming apparatus, and includes an image tray module 15, a finisher module 20, and a paper conveyer module 40.

The image tray module 15 stacks papers finished through the copier 1 onto an image tray 22. The finisher module 20 punches the finished papers using a punch 25 and staples the papers using a stapler 24 so as to stack the papers onto a stack tray 27. The paper conveyer module 40 distributes the papers to the image tray module 15 and the finisher module 20.

The above modules are detachably assembled into the finishing apparatus, and other modules having various functions may additionally be provided to the paper conveyer module.

An example of a related art stapler moving guide device of the stapler 24 provided in the finisher module 20 is disclosed in the Korean Patent Publication No. 2000-28390. The related art stapler moving guide device will be described with reference to FIGS. 2 and 3.

The related art stapler moving guide device 30 positions a stapler frame 31 along the stapler 24 at an opposing position adjoining the end of papers 3. The stapler frame 31 includes a slide groove 33*a* having an extension extending in parallel with the end of the papers 3, and a stapler moving path 33 having first and second tilt slide grooves 33*b* and 33*c* extending from both ends of the slide groove 33*a* to the papers 3 by a predetermined distance with a tilt angle. The slide groove 33*a* and the stapler moving path 33 are provided in the stapler frame to form a single body.

First and second support shafts 34*a* and 34*b* extended below the stapler 24 are fitted into the stapler moving path 33 so that the stapler 24 is slid. A guide plate 35 fixed to the first and second support shafts 34*a* and 34*b* is provided below the stapler frame 31.

The guide plate 35 is fitted into a guide plate moving shaft 36 and is configured to move-along the moving shaft 36. The moving shaft 36 is fixed below the stapler frame 31 in parallel with the slide groove 33*a*.

Belt fitting wheels 39*a* and 39*b* are fixed to both ends of the moving shaft 36. A driving belt 37 is fitted into the belt fitting wheels 39*a* and 39*b* so that it is driven in parallel with the moving shaft 36.

The driving belt 37 is driven by a motor 38 provided in the stapler frame 31, and the circumference of the driving belt 37 is fixed to a belt clamp 41 of the guide plate 35.

Once the driving belt 37 is rotated by rotation of the motor 38, the guide plate 35 connected with the driving belt 37 moves along the moving shaft 36 and the stapler 24 below which the first and second support shafts 34*a* and 34*b* are fixed to the guide plate 35 moves along the moving path 33.

Meanwhile, a first cam hole 42*a* and a second cam hole 42*b* are formed at a portion into which the first and second support shafts 34*a* and 34*b* are fitted. The first cam hole 42*a* is to move the first support shaft 34*a* and the second cam hole 42*b* is to move the second support shaft 34*b*. The first and second cam holes 42*a* and 42*b* have a symmetrical arch shape.

The first and second cam holes 42*a* and 42*b* are formed to rotate the stapler 24 along the tilt slide groove at a certain angle when the stapler 24 moves to the first tilt slide groove 33*b* or the second tilt slide groove 33*c*.

The aforementioned related art stapler moving guide device 30 positions the stapler 24 in a horizontal direction at the center of the papers 3 while in a tilt direction at both corners of the papers, thereby enabling tilt stapling at the corners of the papers.

However, the aforementioned related art stapler moving guide device has several problems.

There is limitation in moving the paper conveyer (not shown in FIGS. 2 and 3) that moves the papers 3 to staple them to the stapler frame 31 where the stapler 24 is positioned.

In other words, to move the stapled papers 3 to stack them onto the stack tray 27, the paper conveyer that pushes the central end of the stapled papers 3 to move to the stack tray is required. Since such a paper conveyer is caught in the stapler if the stapler is positioned at the center, it cannot move to the end of the papers.

For this reason, the stapler moves from the center to the side after stapling operation and then the paper conveyer should move. In addition, since movement of the paper conveyer is determined depending on the position of the stapler, the movement of the paper conveyer may be delayed. Such delay of the movement of the paper conveyer reduces driving efficiency of the stapler moving guide device.

DISCLOSURE OF THE INVENTION

Accordingly, the present invention is directed to a stapler moving guide device that substantially obviate one or more of the problems due to limitations and disadvantages of the related art.

An object of the present invention is to provide a stapler moving guide device that can move paper conveyer regardless of the position of a stapler.

Another object of the present invention is to provide a stapler moving guide device in which a stapler is provided at a side in a tilt direction to enable tilt stapling at the end of papers.

Other object of the present invention is to provide a stapler moving guide device that improves a structure to simultaneously operate a paper conveyer and a stapler regardless of the position of the paper conveyer and the stapler, thereby improving finishing efficiency of papers.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a stapler moving guide device according to the present invention is characterized in that a stapler moving in parallel along the end of papers is provided in such a manner that it is retracted from the center of the papers to an opposite direction of the papers by a predetermined distance, and at the same time the stapler is tilted with respect to the end of the papers when it is positioned at the end of the papers.

To further achieve these and other advantages and in accordance with the purpose of the present invention, a stapler moving guide device according to the present invention includes: a stapler frame provided with a stapler moving path and a horizontal moving guide, the stapler moving path including a recess retracted at the center in an opposite direction of papers and a tilt portion tilting at the end, and the horizontal moving guide being arranged in parallel with the end of the papers, having a tilt portion at one end to be tilted in the same direction as that of the tilt portion of the stapler moving path; a first moving plate reciprocating along the horizontal moving guide; a second moving plate reciprocating on the first moving plate in a direction perpendicular to the horizontal moving guide and moving along with the first moving plate in a horizontal direction; and a stapler fixed onto the second moving plate, wherein an idle roller fixed to the stapler is fitted into the stapler moving path and the first and second moving plates move along with the stapler when the idle roller moves along the stapler moving path.

The idle roller is provided with a pinion gear fixed thereto and the stapler moving path is provided with a rack gear which is engaged with the pinion gear.

The pinion gear fixed to the idle roller is driven by a rotational means.

The tilt portion of the stapler moving path is parallel with the tilt portion of the horizontal moving guide.

The first moving plate includes a guide roller fitted into the horizontal moving guide and moving along the horizontal moving guide.

The first moving plate includes vertical moving guides fixed to slide the second moving plate.

To further still achieve these and other advantages and in accordance with the purpose of the present invention, a stapler moving guide device according to the present invention includes: a lower frame provided in a medium unit of a main body of a paper finishing apparatus; a stapler fixed onto the lower frame, for stapling a predetermined portion of papers while moving on the lower frame; a first support means fixed between the lower frame and the stapler, for supporting the stapler to enable linear reciprocation; a stapler moving motor fixed onto one side of the first support means, for providing a moving force for linear reciprocation; a linear reciprocating means having one end connected with the stapler moving motor and the other end connected with the lower frame; and a side frame fixed onto one side of the lower frame, having a slit of a predetermined length into which papers can externally be inserted and a predetermined inner space for receiving the stapler.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
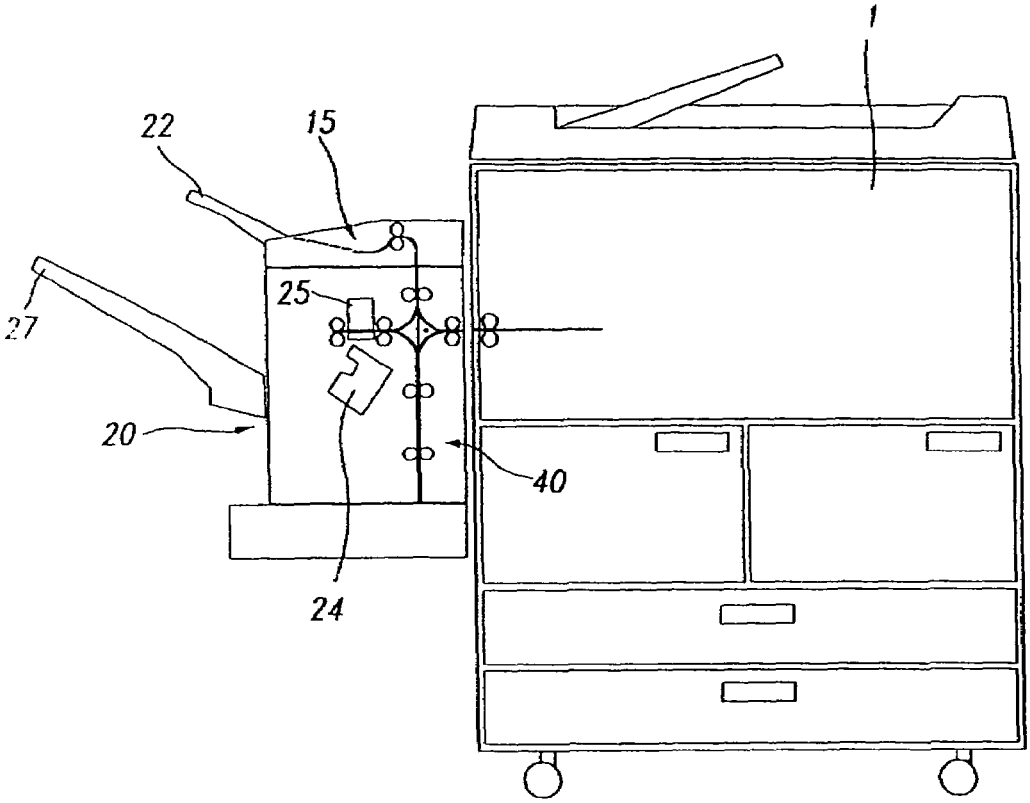
FIG. 1 illustrates a finishing module of a general image forming apparatus.
Figure 2:
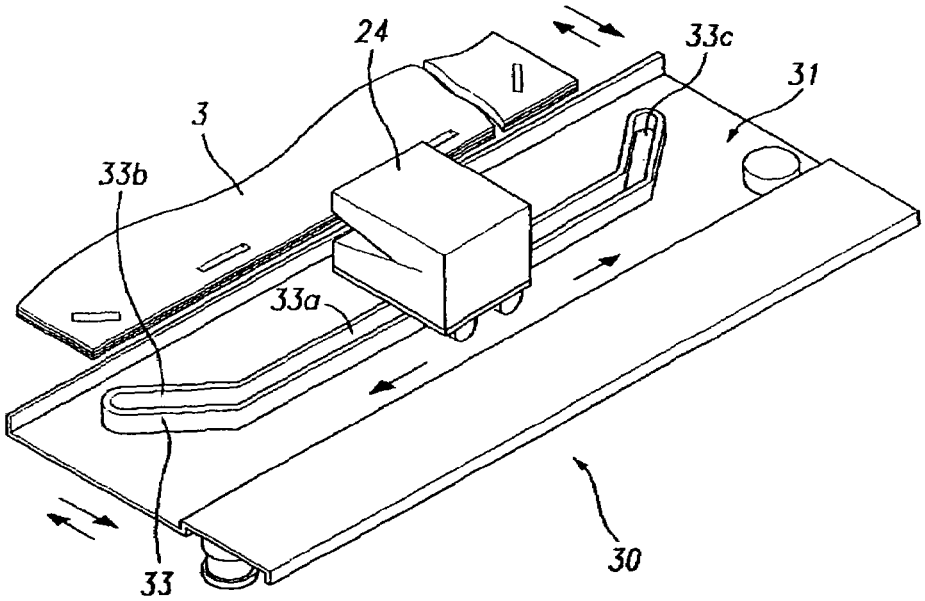
FIG. 2 illustrates one example of a related art stapler moving guide device.
Figure 3:
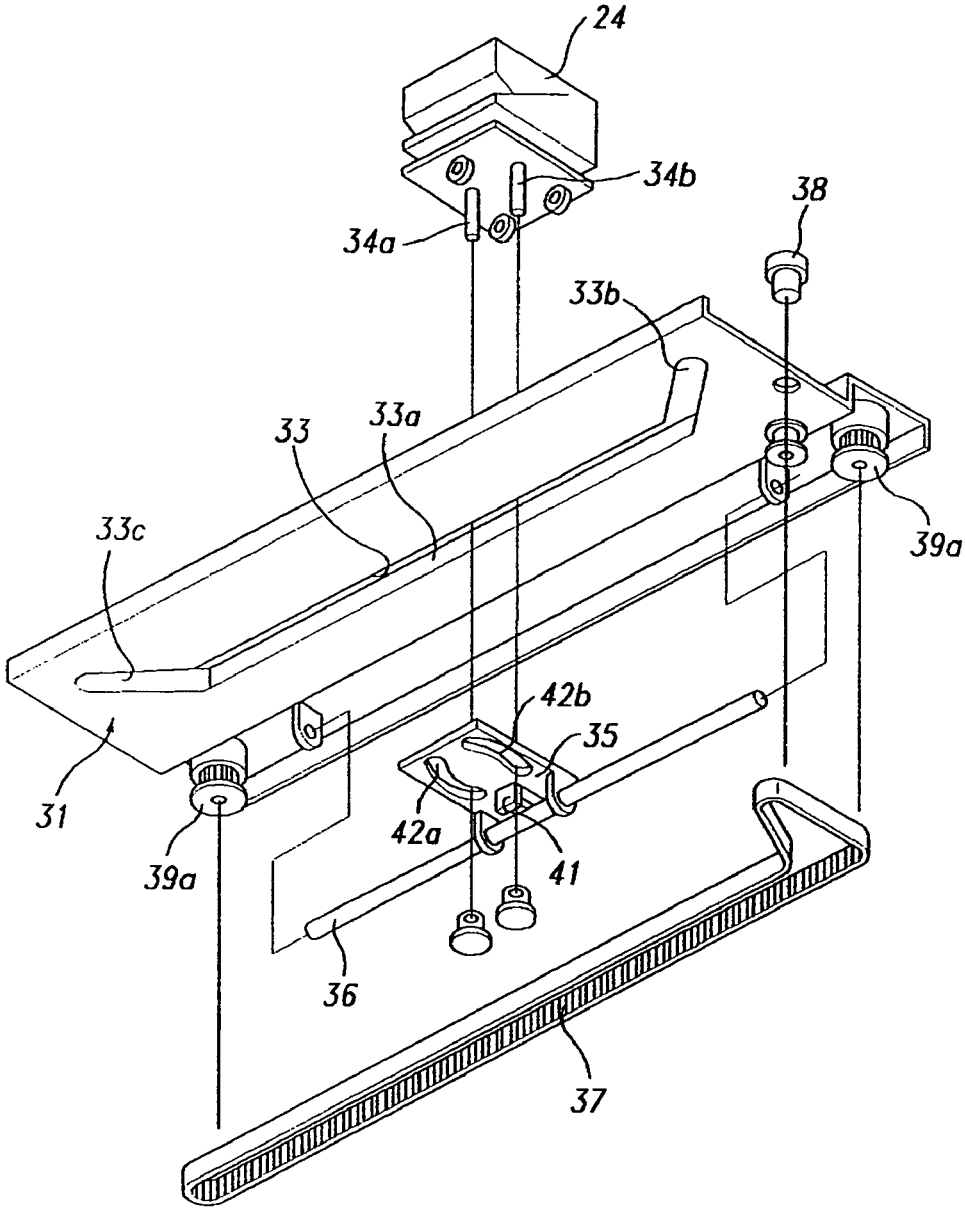
FIG. 3 is an exploded perspective view of the stapler moving guide device of FIG. 2.
Figure 4:
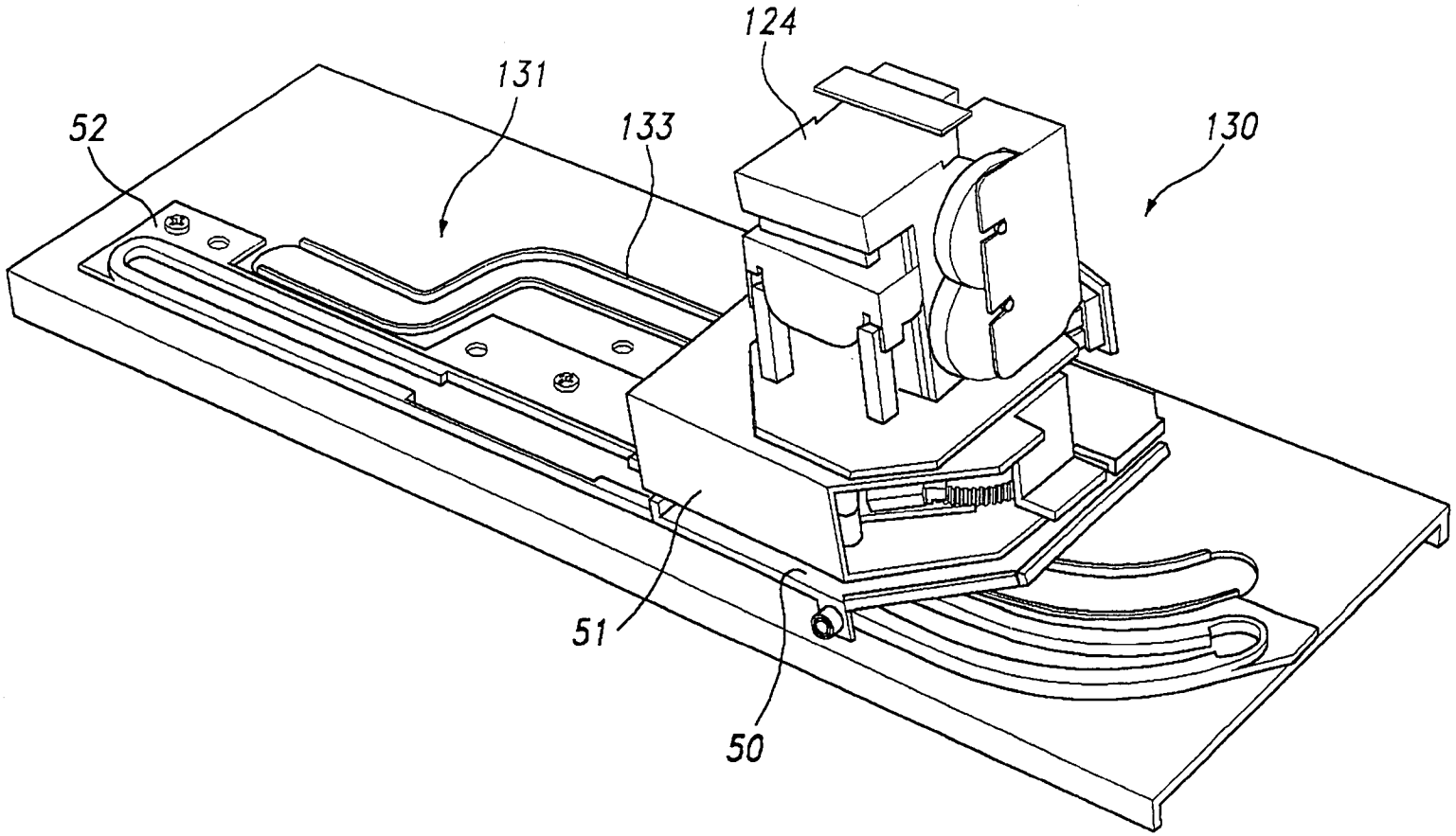
FIG. 4 is a perspective view of a stapler moving guide device according to the first embodiment of the present invention.
Figure 5:
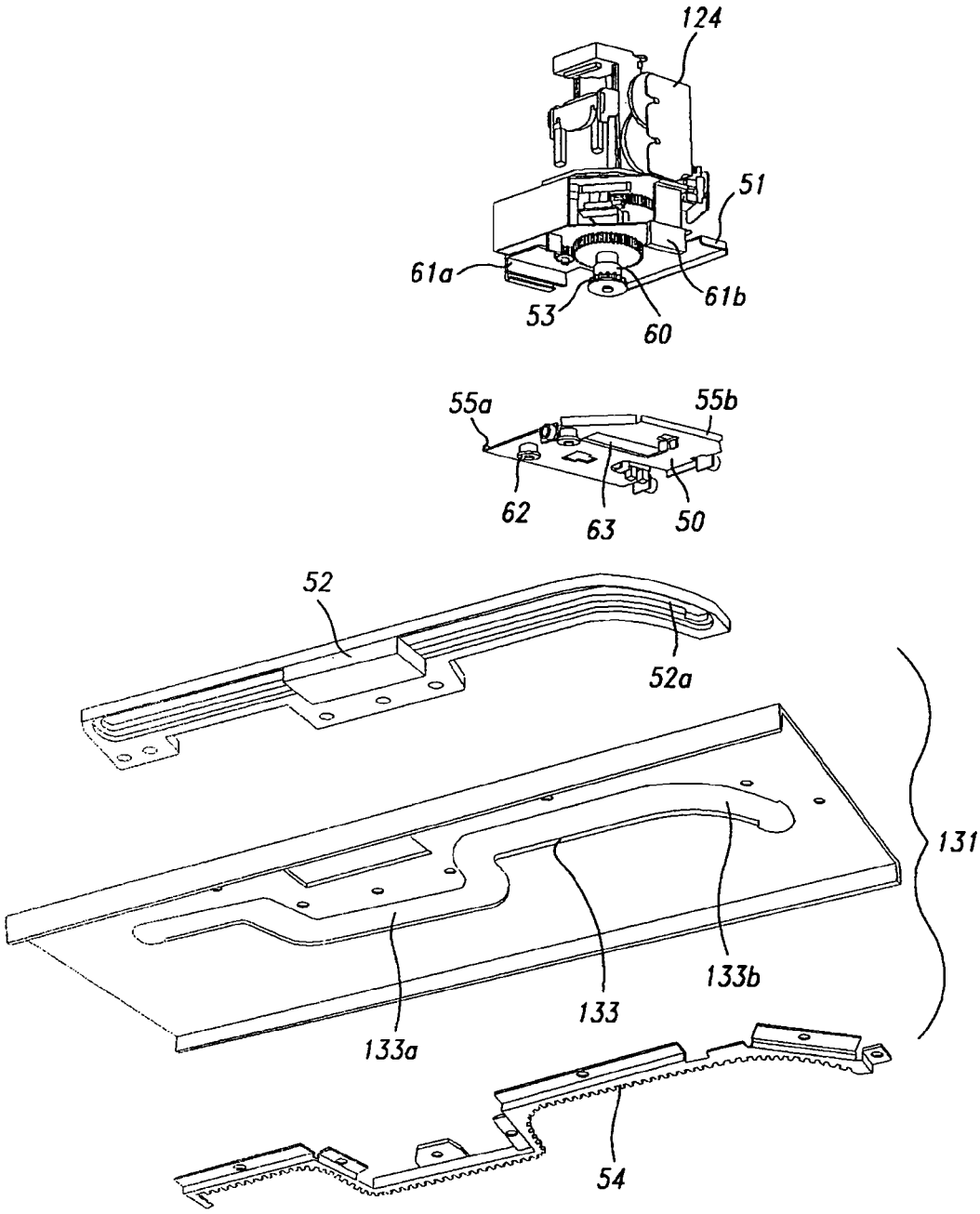
FIG. 5 is an exploded perspective view of the stapler moving guide device according to the first embodiment of the present invention.
Figure 6:
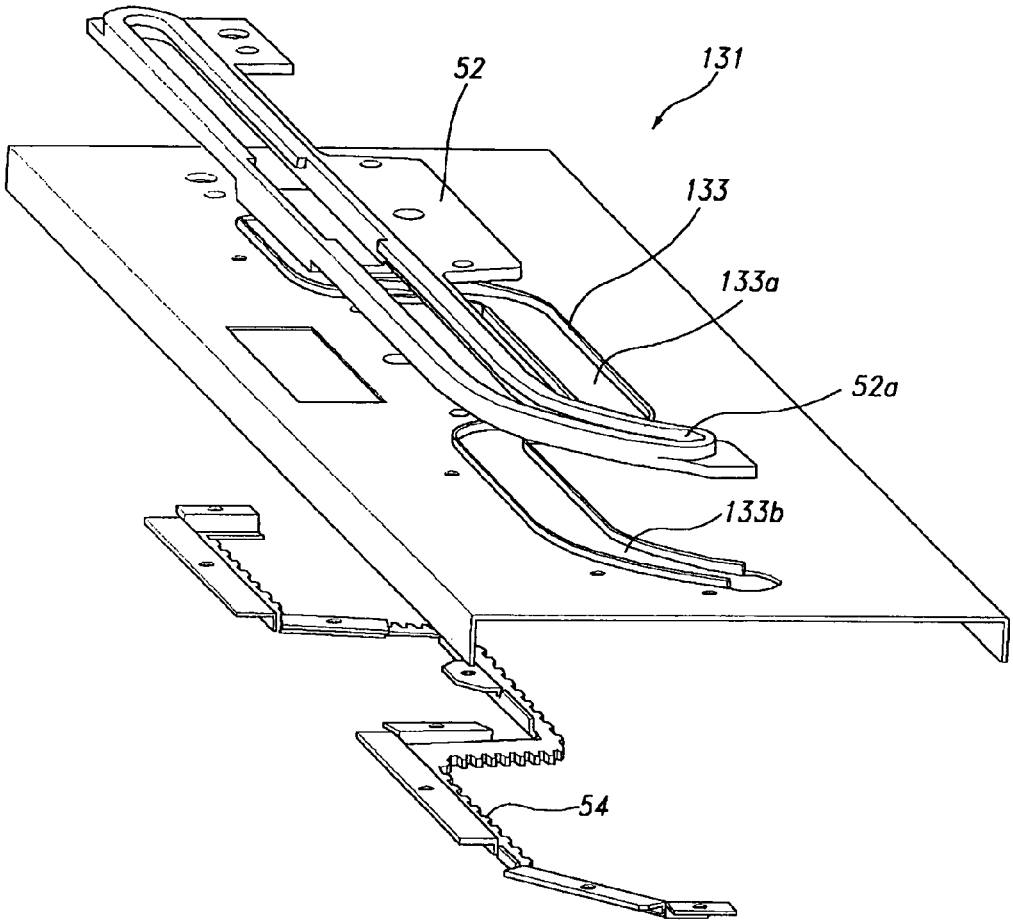
FIG. 6 is an exploded perspective view of a stapler frame of FIG. 5 viewed at another angle.

Reference will now be made in detail to the preferred embodiments of the present invention, examples of which are illustrated in the accompanying drawings.

FIRST EMBODIMENT

A stapler moving guide device according to the first embodiment of the present invention will be described with reference to FIG. 4 to FIG. 7.

The stapler moving guide device according to the first embodiment of the present invention includes a stapler 124, a first moving plate 50, a second moving plate 51, and a stapler frame 131.

The stapler 124 includes an idle roller 60. The idle roller 60 binds papers moved from a copier with an iron core and is fixed to a pinion gear 53 driven by a motor (not shown).

Vertical moving guides 55*a* and 55*b* are provided in the first moving plate 50 so that guides 61*a* and 61*b* provided below the second moving plate 51 are slid along the papers, i.e., in a vertical direction. A slit groove 63 is provided at the center of the first moving plate 50 so that the idle roller 60 is fitted thereinto. This allows the first moving plate 50 to move along with the second moving plate 51 at the time when the second moving plate 51 slides along the vertical moving guides. A guide roller 62 is provided at the lower part of the first moving plate 50 and is fixed to a horizontal moving guide 52 which is provided in the stapler frame 131.

In more detail, the guides 61*a* and 61*b* are provided in the second moving plate 51 and are fixed to the vertical moving guides 55*a* and 55*b* of the first moving plate 50 so that they are slid in a vertical direction along the vertical moving guides. The stapler 124 is provided in such a manner that the idle roller 60 is extended toward the guides 61*a* and 61*b*.

A stapler moving path 133 having a recess 133*a* and a tilt portion 133*b* is provided in the stapler frame 131. The recess 133*a* is retracted at the center in an opposite direction of the papers while the tilt portion 133*b* is tilt at the end. The horizontal moving guide 52 is arranged in parallel with the end of the papers and has a tilt portion 52*a* at one end. The tilt portion 52*a* is tilt in the same direction as that of the tilt portion 133*b* of the stapler moving path 133.

The stapler moving path 133 is provided with a rack gear 54 which is engaged with the pinion gear 53 of the stapler. The guide roller 62 of the first moving plate 50 is fitted into the groove of the horizontal moving guide 52. The first moving plate 50 is slid along the groove of the horizontal moving guide 52. The idle roller 60 of the stapler is fitted into the stapler moving path 133, and the pinion gear 53 fixed to the idle roller 60 is engaged with the rack gear 53 of the stapler moving path 133.

Preferably, the idle roller 60 has a diameter adjoining the width of the stapler moving path 133 so that the rack gear 54 is not detached from the pinion gear 53 in the process of movement.

Once the stapler 124, the first moving plate 50, the second moving plate 51, and the stapler frame 131 are provided as above, the pinion gear 53 and the second moving plate 51 move along the stapler moving path 133 having the rack gear 54 while the first moving plate 50 moves along the horizontal moving guide 52 when the pinion gear 53 is rotated by a motor (not shown).

At the recess 133*a* of the stapler moving path 133, the first moving plate 50 moves in a horizontal direction while the second moving plate moves in horizontal and vertical directions because it is fixed to the first moving plate to move vertically with respect to the first moving plate.

In other words, the second moving plate that fixes the stapler at the center is retracted in an opposite direction of the papers so that the stapler continues to move in a horizontal direction even if the paper conveyer 43 moves to the stapler 124.

Figure 7:
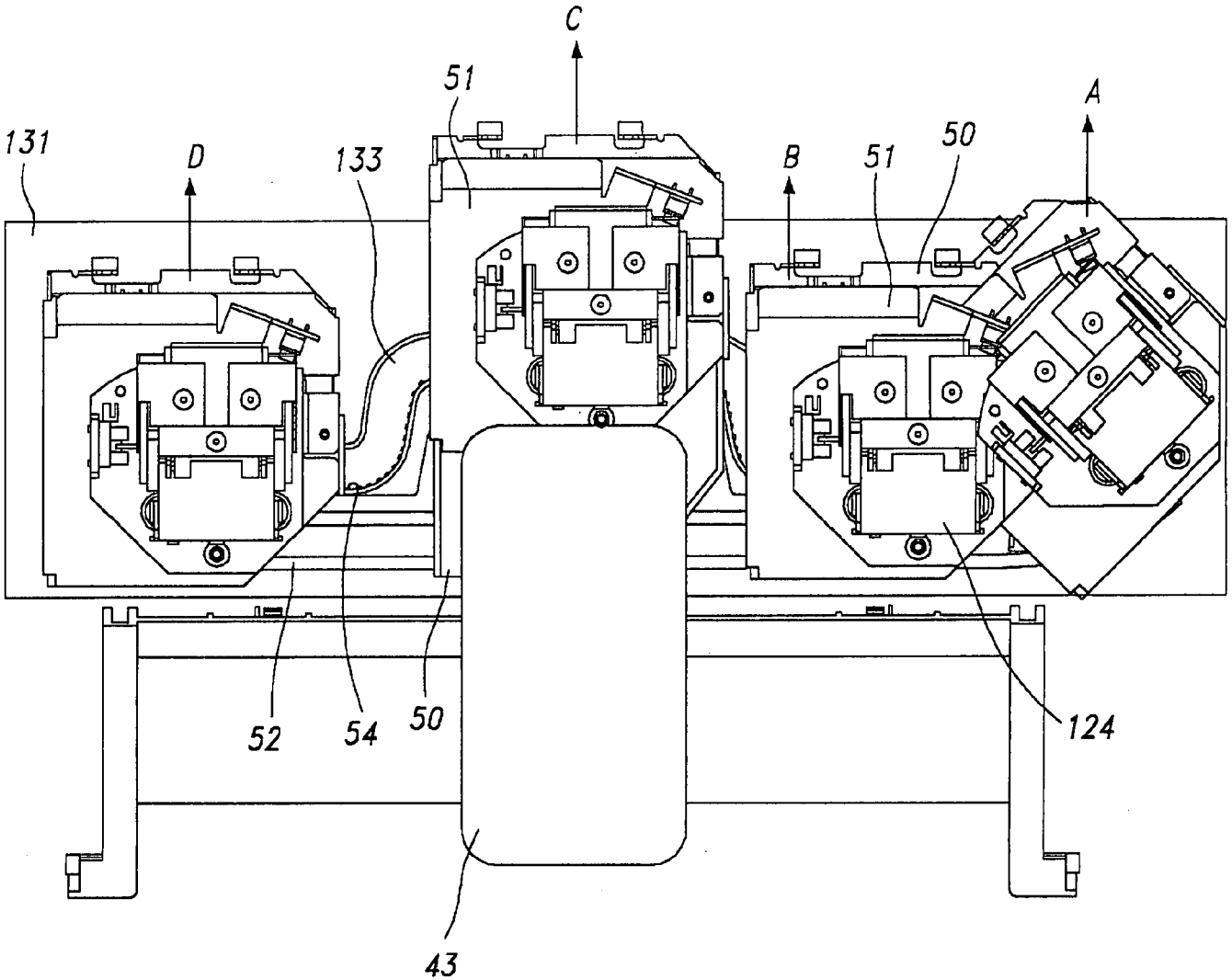
FIG. 7 is a plane view illustrating the operation of the stapler moving guide device according to the first embodiment of the present invention.

The moving operation of the stapler according to the first embodiment of the present invention will be described in more detail with reference to FIG. 7.

If the stapler 124 is positioned at "A," the stapler 124 is arranged in a tilt direction by means of action of the horizontal moving guide 52*a* and the tilt portion 133*b* of the stapler moving path.

Since the stapler is arranged in a tilt direction at the end of the stapler frame 131 as above, it is possible to provide a structure that staples the papers in a tilt direction with respect to the papers or manually staples the papers by easily bring the papers from the outside.

Once the pinion gear 53 is rotated by the motor, the stapler moves from "A" to "B." The first moving plate 50 and the second moving plate 51 are parallel with the horizontal moving guide 52 at the position "B" in a state where the first moving plate 50 overlaps the second moving plate 51. Therefore, the stapler 124 is maintained in parallel with the papers.

At the center, i.e., "C", where the paper conveyer 43 is positioned, the stapler 124 is retracted along with the second moving plate 51 so as not to allow the stapler 124 to be caught in the paper conveyer. At the position "D", the stapler is positioned in the same manner as the position "B".

In the present invention, the horizontal moving guide 52 and the stapler moving path 133 are separately provided in the stapler frame 131. However, they may be provided in the stapler frame 131 to form a single body.

Furthermore, unlike the present invention, the paper conveyer 43 may be provided in such a manner that it moves at a position higher than the stapler 124 or does not move to the stapler moving guide device. However, this structure of the paper conveyer could lead to structural problems that the volume of the device increases and it takes time to move the paper conveyer. Accordingly, this structure will not be dealt with in the present invention.

SECOND EMBODIMENT

A stapler moving guide device according to the second embodiment of the present invention will be described with reference to FIG. 8 to FIG. 12.

Figure 8:
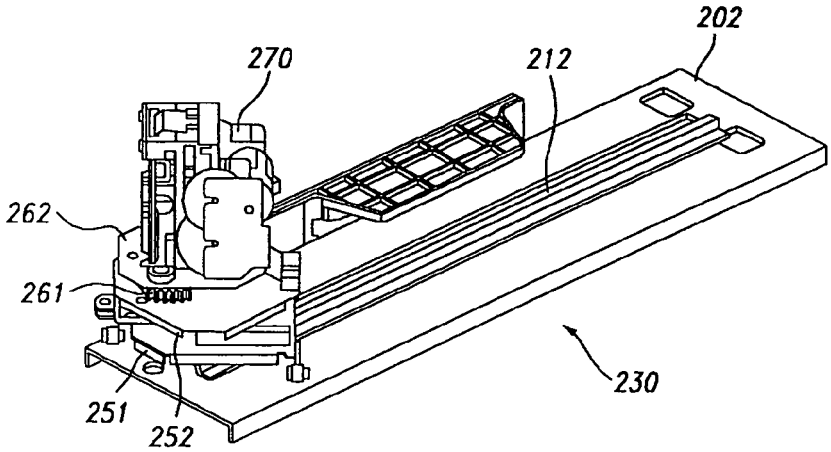
FIG. 8 is a perspective view of a stapler moving guide device according to the second embodiment of the present invention.
Figure 9:
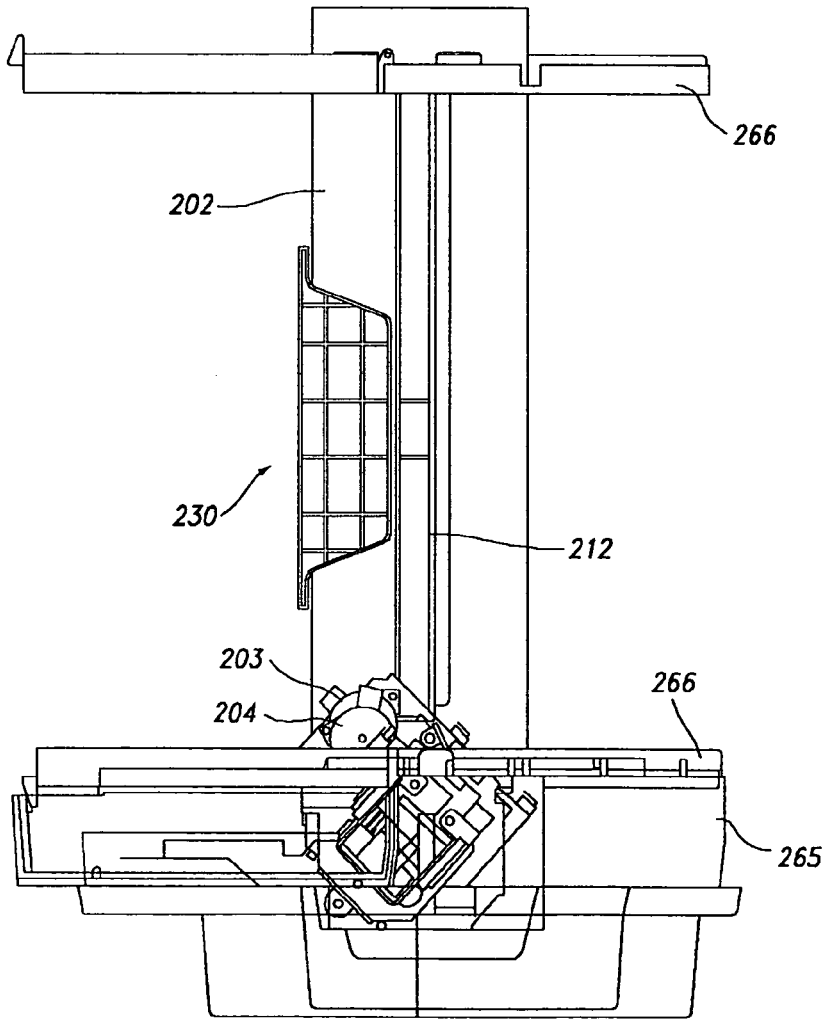
FIG. 9 is a plane view of the stapler moving guide device of FIG. 8.
Figure 10:
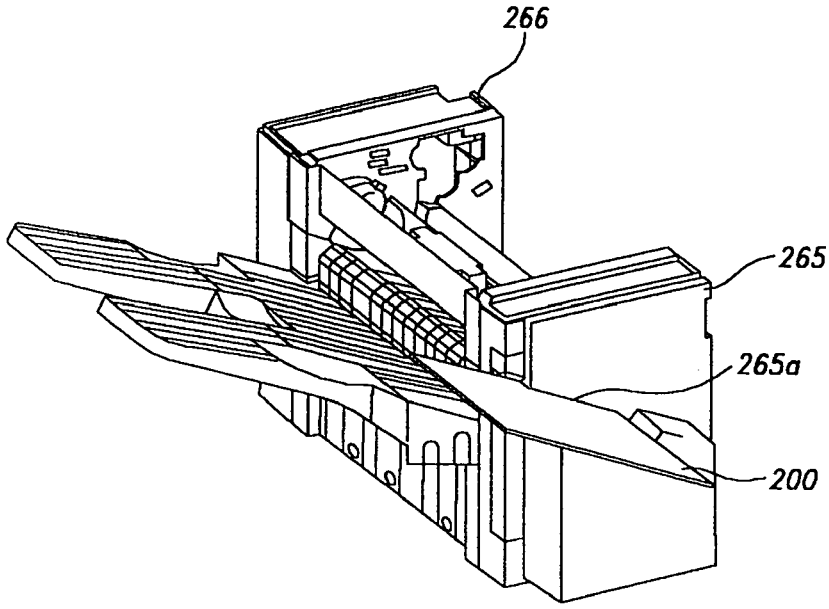
FIG. 10 is a perspective view illustrating the state where a paper finishing apparatus having the stapler moving guide device according to the second embodiment of the present invention is fixed to a medium unit of a main body of a copier.

The stapler moving guide device according to the second embodiment of the present invention, as shown in FIG. 8, includes a lower frame 202 horizontally provided in a medium unit of a main body of a copier, a rack 212 longitudinally arranged on the lower frame 202, first and second moving plates 251 and 252 movably provided on the lower frame 202 in a longitudinal direction and spaced apart from each other at a predetermined interval, a stapler moving motor 203 having a pinion (not shown) engaged with the rack to provide the first and second moving plates 251 and 252 with reciprocation, an arc shaped gear 261 fixed onto the second moving plate 252, a rotary plate 262 rotatably provided on the second moving plate 252, a second stapler rotational motor 204 fixed onto the rotary plate 262 and provided with a pinion (not shown) engaged with the gear 261 to provide the rotary plate 262 with a rotational force, a stapler 270 fixed onto the rotary plate 262, a first side frame 265 fixed onto one side of the lower frame 202, having a slit 265*a* of a predetermined length into which papers 200 can externally be inserted and a predetermined inner space for receiving the stapler 270, and a second side frame 266 fixed onto the other side of the lower frame 202 to oppose the first side frame 265.

Figure 11:
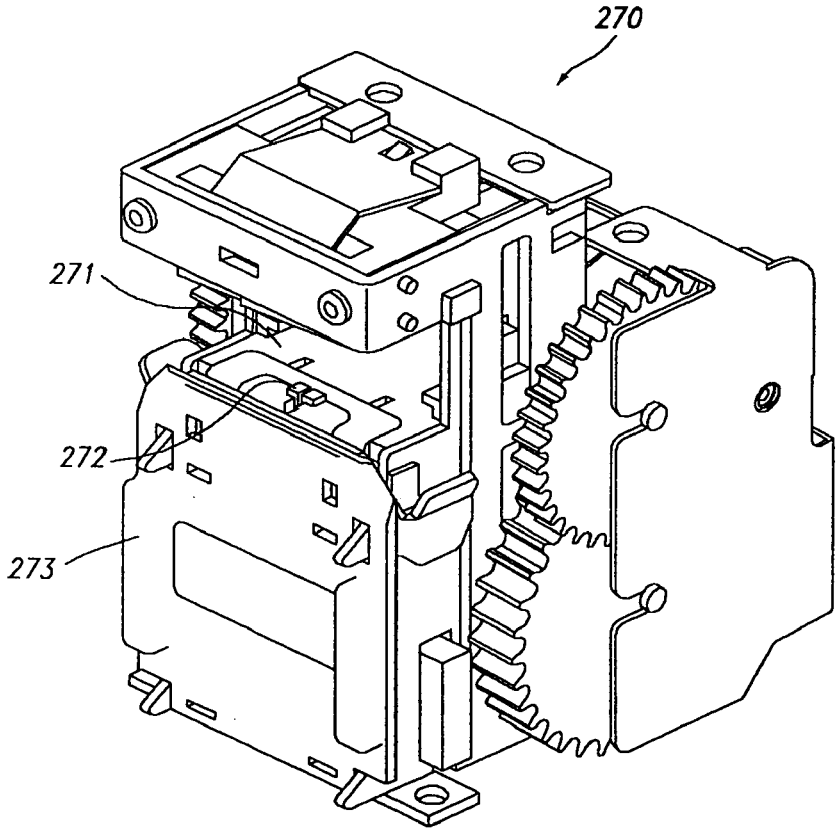
FIG. 11 is a perspective view illustrating a main part of the stapler moving guide device according to the second embodiment of the present invention.

As shown in FIG. 11, a paper sensor 272 is fixed onto a head 271 of the stapler 270 and senses whether the papers are inserted into the slit 265*a* of the first side frame 265. The head 271 is detachably fixed onto a staple cartridge 273.

The respective elements of the aforementioned stapler moving guide device will now be described in more detail.

Figure 12:
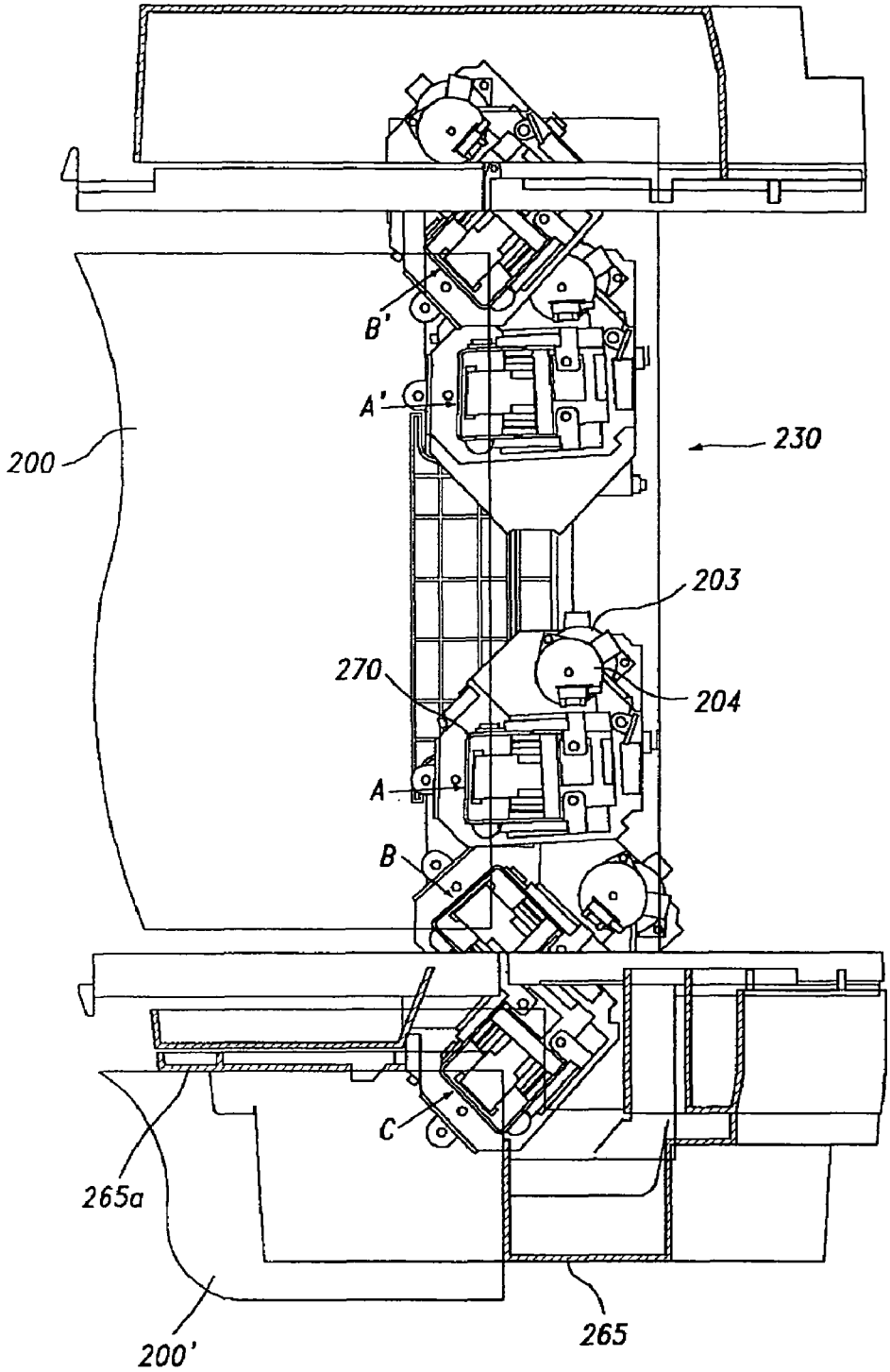
FIG. 12 is a state view illustrating the operation of the stapler moving guide device according to the second embodiment of the present invention.

As shown in FIG. 12, once the stapler moving motor 203 and the stapler rotational motor 204 are driven, the stapler 270 moves and rotates to staple the papers 200.

In other words, the stapler 270 is arranged at "C" of FIG. 12 in a standby state. If the stapler 270 is set to staple both sides at the center of the papers 200 as the papers 200 are aligned, it moves to "A" of FIG. 12 by means of the driving operation of the stapler moving motor 203, thereby stapling the papers. Afterwards, the stapler 270 moves to "A'" to repeatedly perform its stapling function.

Further, if the stapler 270 is set to staple corners of the papers 200, it moves to the end of the papers 200 by means of the stapling moving motor 203. Then, the stapler 270 is rotated by the stapler rotational motor 204 at a predetermined angle (typically, 45°) so as to staple the papers at the position "B" or "B'" of FIG. 12.

Meanwhile, at a standby state that the papers 200 are not fed to the medium unit of the main body of the copier, the stapler 270 is positioned at the position "C" of FIG. 12. In this case, if papers 200' are inserted into the slit 265*a* of the first side frame 265 by a user, the paper sensor 273 of the stapler 270 senses the insertion of the capers 200' and the stapler 270 automatically operates to perform its stapling function.

As described above, the stapler 270 is provided in such a manner that it respectively staples the papers 200 arranged in the medium unit of the copier and the papers 200' externally fed to the medium unit by the user.

In the second embodiment of the present invention, the power transmission of the stapler moving moor 203 is made by the rack 212 and the pinion while the power transmission of the stapler rotational motor 204 is made by the arc gear 261 and the pinion. However, it should be understood that conventional power transmission means such as belts, pulleys, and chain sprockets may be used instead of the rack, the pinion, and the arc gear. In addition, if the first side frame 265 is detachably provided, it may be replaced with another side frame having a slot with a different depth so that various stapling positions may be obtained.

INDUSTRIAL APPLICABILITY

As aforementioned, the stapler moving guide device according to the present invention has the following advantages.

The stapler moving in parallel along the end of the papers is provided in such a manner that it is retracted from the center of the papers to the opposite direction of the papers by a predetermined distance. Also, when the stapler is positioned at the end of the papers, it is tilted with respect to the end of the papers. Therefore, the paper conveyer can freely move regardless of the position of the stapler and vice versa.

Further, since the stapler is tilted at the side of the stapler moving guide device, it is possible to perform tilt stapling at the end of the papers and facilitate insertion of the papers.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A stapler moving guide device comprising:

a stapler frame provided with a stapler moving path and a horizontal moving guide, the stapler moving path including a recess retracted at the center in an opposite direction of papers and a tilt portion tilting at the end, and the horizontal moving guide being arranged in parallel with the end of the papers, having a tilt portion at one end to be tilted in the same direction as that of the tilt portion of the stapler moving path;

a first moving plate reciprocating along the horizontal moving guide;

a second moving plate reciprocating on the first moving plate in a direction perpendicular to the horizontal moving guide and moving along with the first moving plate in a horizontal direction; and a stapler fixed onto the second moving plate, wherein an idle roller fixed to the stapler is fitted into the stapler moving path and the first and second moving plates move along with the stapler when the idle roller moves along the stapler moving path.

2. The stapler moving guide device according to claim 1, wherein the idle roller is provided with a pinion gear fixed thereto and the stapler moving path is provided with a rack gear which is engaged with the pinion gear.

3. The stapler moving guide device according to claim 2, wherein the pinion gear fixed to the idle roller is driven by a rotational means.

4. The stapler moving guide device according to claim 1, wherein the tilt portion of the stapler moving path is parallel with the tilt portion of the horizontal moving guide.

5. The stapler moving guide device according to claim 1, wherein the first moving plate includes a guide roller fitted into the horizontal moving guide and moving along the horizontal moving guide.

6. The stapler moving guide device according to claim 1, wherein the first moving plate includes vertical moving guides fixed to slide the second moving plate.

* * * * *